US009334842B2

(12) United States Patent
Imai et al.

(10) Patent No.: US 9,334,842 B2
(45) Date of Patent: May 10, 2016

(54) FUEL INJECTION VALVE FOR INTERNAL COMBUSTION ENGINE

(71) Applicant: DENSO CORPORATION, Kariya, Aichi-pref. (JP)

(72) Inventors: Keita Imai, Kariya (JP); Eiji Itoh, Anjo (JP); Hiroaki Nagatomo, Kariya (JP)

(73) Assignee: DENSO CORPORATION, Kariya (JP)

( * ) Notice: Subject to any disclaimer, the term of this patent is extended or adjusted under 35 U.S.C. 154(b) by 26 days.

(21) Appl. No.: 14/140,693

(22) Filed: Dec. 26, 2013

(65) Prior Publication Data

US 2014/0175194 A1 Jun. 26, 2014

(30) Foreign Application Priority Data

Dec. 26, 2012 (JP) ..... 2012-283500

(51) Int. Cl.
*B05B 1/30* (2006.01)
*F02M 51/06* (2006.01)

(52) U.S. Cl.
CPC ..... *F02M 51/0614* (2013.01); *F02M 51/0685* (2013.01); *F02M 2200/08* (2013.01)

(58) Field of Classification Search
CPC ..... F02M 51/061; F02M 51/0614; F02M 51/0685
USPC ..... 239/585.1, 585.5
See application file for complete search history.

(56) References Cited

U.S. PATENT DOCUMENTS

| | | | | |
|---|---|---|---|---|
| 4,913,355 | A * | 4/1990 | Thonnessen | 239/585.1 |
| 6,994,281 | B2 | 2/2006 | Reiter | |
| 2008/0011886 | A1 * | 1/2008 | Abe et al. | 239/585.1 |
| 2012/0227709 | A1 * | 9/2012 | Kusakabe | F02M 51/061 123/472 |

FOREIGN PATENT DOCUMENTS

| | | |
|---|---|---|
| EP | 2 570 648 | 3/2013 |
| JP | 2003-328892 | 11/2003 |
| JP | 2008-291735 | 12/2008 |
| JP | 2010-216344 | 9/2010 |
| JP | 2011-241701 | 12/2011 |

OTHER PUBLICATIONS

Office Action (2 pages) dated Mar. 17, 2015, issued in corresponding Japanese Application No. 2012-283500 and English translation (3 pages).

* cited by examiner

*Primary Examiner* — Jason Boeckmann
(74) *Attorney, Agent, or Firm* — Nixon & Vanderhye P.C.

(57) ABSTRACT

A stationary core includes a holding hole that receives and holds a portion of the magnetic spring, which is located on a valve opening side. A solenoid device includes a magnetic yoke that extends in an axial direction and has an axial extent, which overlaps with an entire axial extent of the holding hole. The magnetic yoke has a predetermined portion, which reduces an amount of the magnetic flux that passes through the magnetic yoke in a radial direction in comparison to the rest of the magnetic yoke.

8 Claims, 7 Drawing Sheets

FUEL INJECTION VALVE FOR INTERNAL COMBUSTION ENGINE

CROSS REFERENCE TO RELATED APPLICATION

This application is based on and incorporates herein by reference Japanese Patent Application No. 2012-283500 filed on Dec. 26, 2012.

TECHNICAL FIELD

The present disclosure relates to a fuel injection valve for an internal combustion engine.

BACKGROUND

In a known fuel injection valve, an injection hole of a valve housing is opened and closed by reciprocating a valve member between a valve opening side and a valve closing side in an axial direction. In this specification, the valve opening side is defined as an axial side, which is axially opposite from the injection hole, and the valve closing side is an axial side where the injection hole is located. Therefore, when the valve member is axially moved to the valve opening side, the injection hole is opened to inject fuel through the injection hole. In contrast, when the valve member is axially moved to the valve closing side, the injection hole is closed with the valve member to stop the injection of the fuel.

For example, JP2011-241701A (corresponding to EP02570648A1) recites one such fuel injection valve. In this fuel injection valve, a stationary core is fixed to a valve housing. A magnetic force is exerted between the stationary core and a movable core to move the movable core together with the valve member toward the valve opening side to inject fuel from the fuel injection hole. At this time, in response to energization of a solenoid device fixed to an outer peripheral portion of the stationary core, a magnetic flux is guided to the stationary core and the movable core. Thereby, the magnetic force is exerted between the stationary core and the movable core to magnetically attract with each other. Therefore, when the magnetic force is lost by stopping the energization of the solenoid device, the valve member is urged toward the valve closing side along with the movable core by the spring held by the stationary core. As a result, the injection of fuel through the injection hole is stopped. Thereby, a holding position of the spring by the stationary core has an influence on an injection quantity of fuel from the injection hole.

Lately, the regulations of the exhaust gas of vehicles are increasingly restrictive. Thereby, there is a strong demand for split injection of fuel. In the split injection, a preset amount of fuel, which is preset per combustion cycle, is split into multiple portions, and these multiple portions of fuel are injected through multiple stages (multiple times), respectively, per combustion cycle. In the split injection, an absolute quantity of each injected portion of fuel becomes small. Therefore, variations in the injection quantity of fuel among individual fuel injection valves or among fuel injection operations or variations in the injection quantity of fuel upon the aging may possibly be increased.

In the fuel injection valve recited in JP2011-241701A (corresponding to EP02570648A1), the variations in the injection quantity of fuel tend to occur among the individual fuel injection valves, among the fuel injection operations or due to the aging. This is due to a problem in a positional relationship between a holding hole, which holds a spring on the valve opening side in the stationary core, and a magnetic yoke, through which a magnetic flux passes in the solenoid device. This point will be described below.

In the fuel injection valve recited in JP2011-241701A (corresponding to EP02570648A1), an axial extent of the magnetic yoke overlaps only with an axial extent of a portion of the holding hole. Specifically, the spring is held in the holding hole at a location, which is on the valve opening side of the magnetic yoke in the axial direction besides a location that overlaps with the magnetic yoke in the axial direction.

Here, in the magnetic yoke of the fuel injection valve recited in JP2011-241701A (corresponding to EP02570648A1), a radial thickness of the magnetic yoke is reduced in a predetermined portion located in a corresponding circumferential location in the magnetic yoke. Therefore, a passage cross-sectional area of the magnetic flux, which passes through the magnetic yoke in the radial direction, is reduced in this predetermined portion. In a case of a magnetic spring, which is defined as a spring made of a magnetic material and thereby has a magnetic property, the magnetic spring is magnetically urged toward the radial side, which is opposite from the predetermined portion, in the axial extent that overlaps with the axial extent of the magnetic yoke. However, the magnetic spring may be displaced to any radial location in the axial extent, which is located on the valve opening side of the magnetic yoke. Therefore, at the time of assembling the fuel injection valve, when the position of the magnetic spring is deviated to the other location, which is other than the radially opposite side that is radially opposite to the predetermined portion, the variations occur in the injection quantity of fuel among the fuel injection valves. Also, at the time of operating the fuel injection valve, when the position of the magnetic spring is deviated to the other location, which is other than the radially opposite side that is radially opposite to the predetermined portion, through the fuel injection operations or upon a long time use (aging), the variations occur in the injection quantity of fuel among the fuel injection operations or through the aging.

SUMMARY

The present disclosure addresses the above disadvantages. According to the present disclosure, there is provided a fuel injection valve for an internal combustion engine, including a valve housing, a valve member, a stationary core, a movable core, a magnetic spring and a solenoid device. The valve housing includes an injection hole, which is configured to inject fuel in the internal combustion engine. The valve member is configured to reciprocate between a valve opening side and a valve closing side, which are opposite to each other in an axial direction, to respectively open and close the injection hole. The stationary core is fixed to the valve housing. The movable core is movable together with the valve member. The movable core moves toward the valve opening side when a magnetic force is exerted between the stationary core and the movable core. The magnetic spring is made of a magnetic material. The magnetic spring is held by the stationary core and urges the valve member toward the valve closing side. The solenoid device is held on a radially outer side of the stationary core and generates the magnetic force by guiding a magnetic flux to the stationary core and the movable core in response to energization of the solenoid device. The stationary core includes a holding hole that receives and holds a portion of the magnetic spring, which is located on the valve opening side. The solenoid device includes a magnetic yoke that extends in the axial direction and has an axial extent, which overlaps with an entire axial extent of the holding hole. The magnetic yoke has a predetermined portion that reduces an amount of the magnetic flux, which passes through the magnetic yoke in a radial direction, in comparison to the rest of the magnetic yoke.

BRIEF DESCRIPTION OF THE DRAWINGS

The drawings described herein are for illustration purposes only and are not intended to limit the scope of the present disclosure in any way.

DETAILED DESCRIPTION

Figure 1:
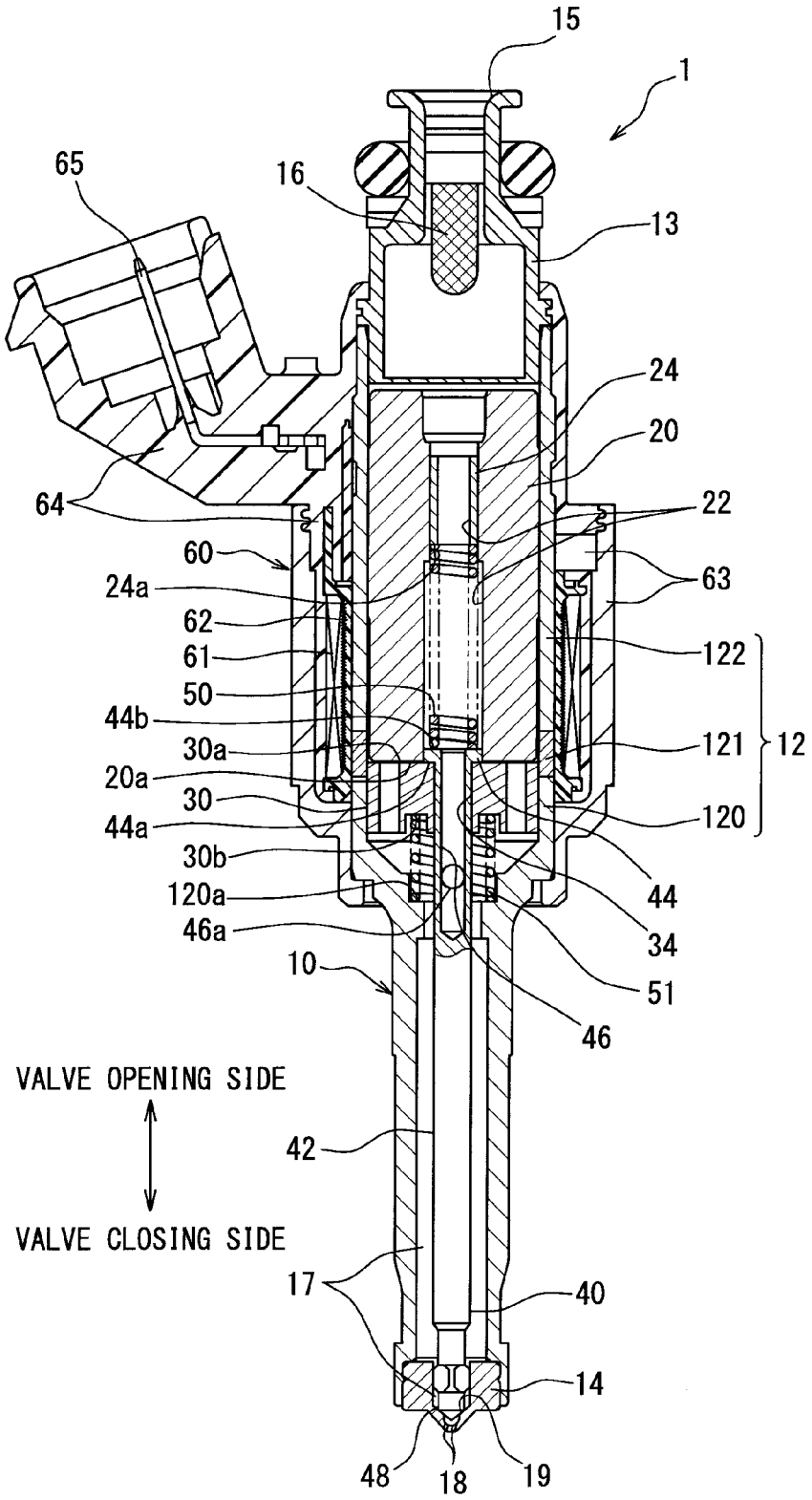
FIG. 1 is a longitudinal cross-sectional view of a fuel injection valve according to an embodiment of the present disclosure.

An embodiment of the present disclosure will be described with reference to the accompanying drawings. According to the present embodiment, a fuel injection valve 1 of FIG. 1 is installed to a gasoline engine (serving as an internal combustion engine) and injects fuel into a combustion chamber (not shown) of the gasoline engine. Alternatively, in a modification of the present embodiment, the fuel injection valve 1 may be implemented as a fuel injection valve, which injects fuel into an air intake passage communicated with the combustion chamber of the gasoline engine.

First of all, a structure of the fuel injection valve 1 will be described. The fuel injection valve 1 includes a valve housing 10, a stationary core 20, a movable core 30, a valve member 40, a valve-closing spring 50, a valve-opening spring 51, and a solenoid device 60.

The valve housing 10 includes a main member 12, an inlet member 13 and a nozzle member 14. The main member 12 is configured into a cylindrical tubular form and includes a first magnetic portion 120, a non-magnetic portion 121 and a second magnetic portion 122, which are arrange in this order in the axial direction form a valve closing side to a valve opening side. The first and second magnetic portions 120, 122 are made of a magnetic metal material, and the non-magnetic portion 121 is made of a non-magnetic metal material. The first and second magnetic portions 120, 122 and the non-magnetic portion 121 are joined together by, for example, laser welding. With the above joined structure, the non-magnetic portion 121 limits magnetic short-circuit between the first magnetic portion 120 and the second magnetic portion 122.

The inlet member 13 is configured into a cylindrical tubular form and is fixed to an end part of the second magnetic portion 122, which is opposite from the non-magnetic portion 121. The inlet member 13 forms a fuel inlet 15, which receives fuel from a fuel pump (not shown). A fuel filter 16 is placed on a radially inner side of the inlet member 13 to filter the fuel supplied into the fuel inlet 15.

A nozzle member 14 is fixed to a part of the first magnetic portion 120, which is opposite from the non-magnetic portion 121. The nozzle member 14 is configured into a cylindrical cup form. The nozzle member 14 cooperates with the main member 12 to form a fuel passage 17, which conducts the fuel. The nozzle member 14 has injection holes 18 and a valve seat 19. The injection holes 18, which are communicated with the fuel passage 17, are arranged circumferentially about a central axis of the nozzle member 14. Each injection hole 18 is formed as a cylindrical hole. The valve seat 19 is placed on an upstream side of the respective injection holes 18 and is formed as a conical surface, which surrounds the fuel passage 17.

The stationary core 20 is made of a magnetic metal material and is configured into a cylindrical tubular form. The stationary core 20 is coaxially fixed to an inner peripheral surface of the non-magnetic portion 121 and an inner peripheral surface of the second magnetic portion 122. An adjusting pipe 24, which is made of a metal material and is configured into a cylindrical tubular form, is press fitted to a radial center part of the stationary core 20 in a coaxial manner. The stationary core 20 cooperates with the adjusting pipe 24 to form a communication passage 22, which is communicated with the fuel inlet 15 located on the upstream side. The communication passage 22 guides the fuel supplied through the fuel inlet 15 to the downstream side.

The movable core 30, which is made of a magnetic metal material and is configured into a cylindrical tubular form, is coaxially received on a radially inner side of the main member 12 at a location, which is on the valve closing side of the stationary core 20. The movable core 30 is configured to reciprocate between the valve opening side and the valve closing side in the axial direction. At the time of moving the movable core 30 toward the stationary core 20, an axial end surface 30*a* of the movable core 30 contacts an axial end surface 20*a* of the stationary core 20 at a moving end of the movable core 30 on the valve opening side. Thereby, movement of the movable core 30 is stopped. The movable core 30 has an axial hole 34, which is a cylindrical hole that extends in the axial direction and is located at a radial center part of the movable core 30.

The valve member 40 is made of a non-magnetic metal material and is configured into an elongated cylindrical rod form (a needle form). The valve member 40 is coaxially placed on a radially inner side of the main member 12 and the nozzle member 14 and is configured to reciprocate between the valve opening side and the valve closing side. The valve member 40 includes a shaft portion 42, which is configured into a cylindrical rod form and extends in the axial direction. The shaft portion 42 is coaxially fitted into the axial hole 34, so that the shaft portion 42 extends through the movable core 30 in the axial direction to reciprocate in the axial direction.

The valve member 40 also includes a projection 44 located at a base end of the valve member 40 on the valve opening side. The projection 44 radially outwardly projects from the shaft portion 42 and is configured into a cylindrical flange form. The projection 44 has an outer diameter, which is larger than an inner diameter of the axial hole 34. An axial end surface 44*a* of the projection 44, which faces the valve closing side, contacts the axial end surface 30*a* of the movable core 30, which faces the valve opening side. The valve member 40 can reciprocate together with the movable core 30.

The valve member 40 includes a fuel hole 46, which extends through the shaft portion 42 and the projection 44. An opening end of the fuel hole 46, which opens at the projection 44 on the valve opening side of the movable core 30, is communicated with a downstream portion of the communication passage 22. The fuel hole 46 has an opening 46*a*, which opens in the shaft portion 42 on the valve closing side of the movable core 30 and is communicated with an upstream side portion of the fuel passage 17. With the above-described communicating structure, the fuel hole 46 conducts the fuel from the communication passage 22 to the fuel passage 17 regardless of the operational position of the valve member 40.

The valve member 40 has a seat portion 48, which is formed at a distal end portion of the valve member 40 on the valve closing side and is opposed to the valve seat 19. When the valve member 40 is moved toward the valve opening side, the seat portion 48 is lifted from the valve seat 19. Thereby, the valve member 40 opens the injection holes 18 to the fuel passage 17. As a result, the fuel of the fuel passage 17 is injected into the combustion chamber through the respective injection holes 18. In contrast, when the valve member 40 is moved toward the valve closing side, the seat portion 48 is seated against the valve seat 19. Thereby, the injection holes 18 are closed relative to the fuel passage 17. As a result, the injection of the fuel through the respective injection holes 18 is stopped. As discussed above, when the valve member 40 is reciprocated to open and close the respective injection holes 18, the injection of the fuel through the respective injection holes 18 is enabled and disabled, respectively.

The valve-closing spring 50 is a compression coil spring made of a metal material and is coaxially received on the radially inner side of the stationary core 20. The valve-closing spring 50 is clamped between an axial end surface 24*a* of the adjusting pipe 24, which is located on the valve closing side, and an axial end surface 44*b* of the projection 44, which is located on the valve opening side. With this clamping structure, the valve-closing spring 50 exerts a resilient restoring force in response to compression of the valve-closing spring 50 between the adjusting pipe 24 and the projection 44. Thereby, the valve-closing spring 50 urges the valve member 40 toward the valve closing side.

The valve-opening spring 51 is a compression coil spring made of a metal material. The valve-opening spring 51 is coaxially placed on a radially outer side of the shaft portion 42 at a corresponding location that is on a radially inner side of the main member 12. The valve-closing spring 50 is clamped between a recessed surface 30*b* of the movable core 30, which is directed to the valve closing side, and a stepped surface 120*a* of the first magnetic portion 120, which is directed to the valve opening side. With the-above described clamping structure, the valve-opening spring 51 exerts a resilient restoring force in response to the compression of the valve-opening spring 51 between the movable core 30 and the first magnetic portion 120. Thereby, the valve-opening spring 51 urges the movable core 30 toward the valve opening side.

The solenoid device 60 is held on a radially outer side of the stationary core 20 and generates a magnetic force by guiding a magnetic flux to the stationary core 20 and the movable core 30 in response to energization of the solenoid device 60. The solenoid device 60 includes a solenoid coil 61, a dielectric bobbin 62, a magnetic yoke 63, a connector 64 and a plurality of terminals 65. The solenoid coil 61 is formed by winding a metal wire around the dielectric bobbin 62, which is made of a resin material (dielectric resin material). The solenoid coil 61 is coaxially fixed to the outer peripheral surfaces of the first and second magnetic portions 120, 122 and the non-magnetic portion 121 through the dielectric bobbin 62 at the corresponding location, which is on the radially outer side of the stationary core 20. The magnetic yoke 63, which is made of a magnetic metal material and is configured into a cylindrical tubular form, is coaxially fixed to the outer peripheral surfaces of the first and second magnetic portions 120, 122 on the radially outer side of the stationary core 20 and the movable core 30. Thereby, the magnetic yoke 63 covers an outer peripheral portion of the solenoid coil 61. One circumferential portion of the connector 64, which is made of a resin material (dielectric resin material), projects outward through an opening 632 of the magnetic yoke 63. The terminals 65, which are made of a metal material and are embedded in the connector 64, electrically connect the solenoid coil 61 to an external control circuit (not shown). With the above-described electrical connection, energization of the solenoid coil 61 (i.e., supply of an electric current to the solenoid coil 61) can be controlled with the control circuit.

In the valve opening operation of the fuel injection valve 1, which is constructed in the above-described manner, when the solenoid coil 61 is magnetized through the energization by the control circuit, a magnetic flux is guided through the magnetic yoke 63, the first magnetic portion 120, the movable core 30, the stationary core 20 and the second magnetic portion 122. That is, a magnetic circuit is formed to pass the magnetic flux through the magnetic yoke 63, the first magnetic portion 120, the movable core 30, the stationary core 20 and the second magnetic portion 122. Thereby, a magnetic force (a magnetic attractive force), which attracts the movable core 30 toward the stationary core 20, is exerted between the stationary core 20 and the movable core 30. When a sum of this magnetic force and the restoring force of the valve-opening spring 51 becomes larger than the restoring force of the valve-closing spring 50, the movable core 30 urges the projection 44, which is in contact with the axial end surface 30*a*, toward the valve opening side. Thus, the valve member 40 and the movable core 30 are moved together toward the valve opening side, so that the seat portion 48 is lifted from the valve seat 19, and thereby the fuel is injected through the respective injection holes 18.

When the movable core 30 is moved toward the valve opening side, the movable core 30 collides against the axial end surface 20*a* of the stationary core 20. Thereby, the movable core 30 is stopped by the stationary core 20. At this time, the valve member 40 maintains the inertial movement thereof, so that the projection 44 of the valve member 40 is spaced away from the axial end surface 30*a*. In this way, even when the movable core 30 is bounced back toward the valve closing side by a collision reaction force generated at the time of collision of the movable core 30 against the stationary core 20, application of the collision reaction force to the valve member 40 is limited due to the spacing of the valve member 40 away from the axial end surface 30*a* of the movable core 30. Thus, the bouncing of the valve member 40 toward the valve closing side is limited to limit erroneous closing of the respective injection holes 18 with the valve member 40, and thereby it is possible to limit variations in the injection quantity of the fuel injected through the injection holes 18. Furthermore, when the valve member 40 is spaced away from the axial end surface 30*a* of the movable core 30, the valve member 40 receives the restoring force of the valve-closing spring 50, which is exerted toward the valve closing side. Therefore, overshooting, which is the excessive movement of the valve member 40 toward the valve opening side, is limited.

In the valve closing operation, which is executed after the valve opening operation, the solenoid coil 61 is demagnetized through deenergization of the solenoid coil 61 by the control circuit. Thus, the magnetic force between the stationary core 20 and the movable core 30 is lost. Because of the loss of the magnetic force, the valve member 40 receives the restoring force of the valve-closing spring 50, which is larger than the restoring force of the valve-opening spring 51. Thereby, the movable core 30, which contacts the axial end surface 44*a* of the valve member 40, is urged toward the valve closing side. Therefore, the valve member 40 is moved toward the valve closing side together with the movable core 30. Thus, the seat portion 48 is seated against the valve seat 19, so that the injection of the fuel through the respective injection holes 18 is stopped.

Next, a spring holding structure of the fuel injection valve 1, which holds the valve-closing spring 50, will be described in detail.

Figure 2:
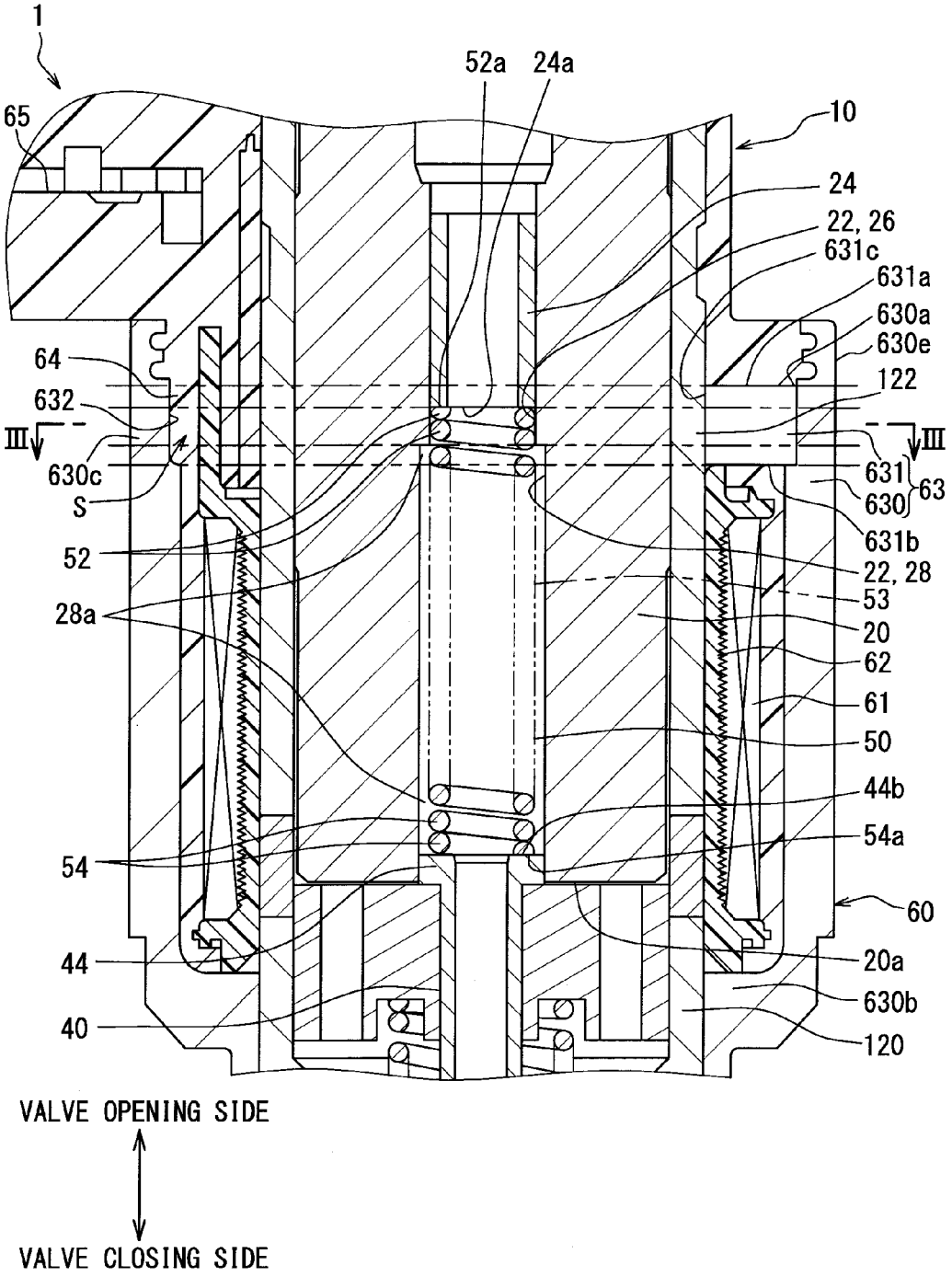
FIG. 2 is a partial enlarged view of the fuel injection valve shown in FIG. 1.
Figure 3:
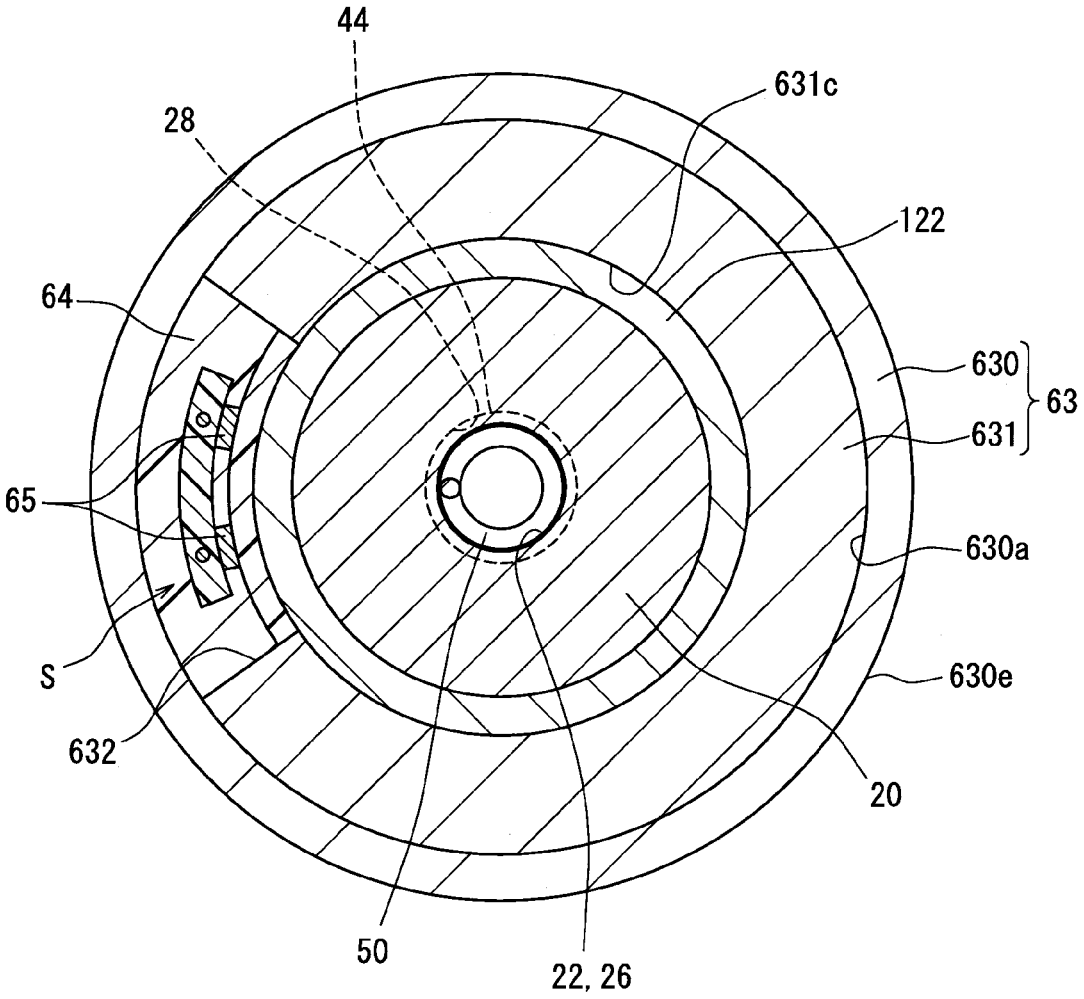
FIG. 3 is a cross sectional view taken along line III-III in FIG. 2.

As shown in FIGS. 2 and 3, the magnetic yoke 63 includes a first yoke portion 630 and a second yoke portion 631, both of which are made of a magnetic metal material. The first yoke portion 630 is configured into a cylindrical cup form and thereby includes a cylindrical peripheral wall part 630*e* and a bottom wall part 630*b*. Specifically, the cylindrical peripheral wall part 630*e* of the first yoke portion 630 continuously extends in the circumferential direction and has a substantially constant radial wall thickness along the entire circumferential extent of the cylindrical peripheral wall part 630*e*. An opening 630*a* of the cylindrical peripheral wall part 630*e* opens on the valve closing side. The bottom wall part 630*b* radially inwardly projects from an opposite end of the cylindrical peripheral wall part 630*e*, which is axially opposite from the opening 630*a*. The bottom wall part 630*b* of the first yoke portion 630, which is located on the valve closing side, is fixed to the outer peripheral surface of the first magnetic portion 120.

The second yoke portion 631 is configured into a partially cut ring form (a C-shape form also referred to as a C-ring), which has the opening 632 at a single circumferential location (hereinafter referred to as a predetermined portion) S thereof. The second yoke portion 631 radially inwardly extends from an inner peripheral surface of the opening 630*a* of the cylindrical peripheral wall part 630*e* and contacts an outer peripheral wall (outer peripheral surface) of the second magnetic portion 122 at a contact surface 631 c formed in a radially inner end part (an inner peripheral wall) of the second yoke portion 631. More specifically, the peripheral wall of the second yoke portion 631 has a substantially constant radial wall thickness along the entire circumferential extent of the peripheral wall of the second yoke portion 631. The second yoke portion 631 is coaxially fitted between the inner peripheral surface of the opening 630*a* of the cylindrical peripheral wall part 630*e* of the first yoke portion 630 and the outer peripheral surface of the second magnetic portion 122 in the radial direction. Furthermore, as shown in FIG. 2, the solenoid coil 61 and the dielectric bobbin 62 are placed between the second yoke portion 631 and the bottom wall part 630*b* in the axial direction. With this accommodation form, the second yoke portion 631 is placed on the valve opening side of the solenoid coil 61. Also, the solenoid coil 61 and the dielectric bobbin 62 are placed between the cylindrical peripheral wall part 630*e* of the first yoke portion 630 and the main member 12 (more specifically, the second magnetic portion 122, the non-magnetic portion 121 and the first magnetic portion 120) in the radial direction.

As shown in FIGS. 2 and 3, the predetermined portion S, in which the opening 632 of the second yoke portion 631 is formed, is used as the portion, through which the connector 64 projects outwardly. That is, in the predetermined portion S, the resin material of the connector 64 and the terminals 65 extend into the opening 632. Thus, at the time of energizing the solenoid coil 61, the magnetic flux can pass through the remaining portion (i.e., the C-shaped magnetic material portion) of the magnetic yoke 63, which is other than the predetermined portion S, as indicated by arrows in FIG. 4. The amount of the magnetic flux, which radially passes in the magnetic yoke 63, is reduced in the opening 632. Thereby, the density distribution of the magnetic flux, which passes through the second yoke portion 631 in the radial direction, is not uniform, i.e., is unequal in the circumferential direction.

As shown in FIGS. 2 and 3, the stationary core 20 includes a holding hole 26 and a loosely receiving hole 28, which are placed adjacent to each other and form the communication passage 22. The holding hole 26 is a center hole portion, which is placed in a radial center part of the stationary core 20 shown in FIG. 2 and is adjacent to the valve closing side portion of the adjusting pipe 24. An axial extent of the holding hole 26 does not reach the axial end surface 20*a* of the stationary core 20. An inner diameter of the holding hole 26 is set to be larger than an inner diameter of the adjusting pipe 24. With this setting of the inner diameter of the adjusting pipe 24, the axial end surface 24*a* of the adjusting pipe 24 is exposed in the holding hole 26.

Here, the entire axial extent of the holding hole 26 is on the valve closing side of the one axial end surface 631*a* of the second yoke portion 631 and is on the valve opening side of the other axial end surface 631 b of the second yoke portion 631. With this arrangement, the entire axial extent of the holding hole 26 overlaps only with an axial extent of the second yoke portion 631 (the second yoke portion 631 forming the opening 632 in the predetermined portion S) and an axial extent of an outer tubular section 630*c* of the cylindrical peripheral wall part 630*e* of the first yoke portion 630. Here, the outer tubular section 630*c* is defined as a section that covers an outer peripheral surface of the second yoke portion 631. That is, the axial extent of the predetermined portion S of the magnetic yoke 63, which is defined by the second yoke portion 631 and the outer tubular section 630*c*, overlaps with the entire axial extent of the holding hole 26. In other words, the entire axial extent of the holding hole 26 is located within the axial extent of the second yoke portion 630, more specifically, within an axial extent of the contact surface 631*c* of the second yoke portion 630, which contacts the outer peripheral surface of the second magnetic portion 122.

The loosely receiving hole 28 is a center hole portion, which is placed in the radial center part of the stationary core 20 and is adjacent to the valve closing side portion of the holding hole 26. An axial extent of the loosely receiving hole 28 reaches the axial end surface 20*a* of the stationary core 20. As shown in FIGS. 2 and 3, an inner diameter of the loosely receiving hole 28 is set to be larger than the inner diameter of the holding hole 26 to such an extent that the loosely receiving hole 28 enable reciprocating slide movement of the projection 44 in the loosely receiving hole 28.

The valve-closing spring 50 of the present embodiment serves as a magnetic spring, which is made of the magnetic material (more specifically, the magnetic metal material) and has the magnetic property. In the present embodiment, the valve-closing spring 50 is a compression coil spring, which has two ground axial end surfaces 52*a*, 54*a* and is made of the magnetic material, more specifically, the magnetic metal material. As shown in FIG. 2, the valve-closing spring 50 has two wound end portions 52, 54. The wound end portion 52 includes a predetermined number of turns (two turns in this embodiment) from the valve opening side axial end of the valve-closing spring 50, and the wound end portion 54 includes a predetermined number of turns (two turns in this embodiment) from the valve closing side axial end of the valve-closing spring 50. The wound end portions 52, 54 do not substantially contribute to the generation of the restoring force.

The wound end portion 52 of the valve-closing spring 50, which is located on the valve opening side, is coaxially fitted into the holding hole 26 and is thereby held by the stationary core 20. Here, particularly, the ground axial end surface 52*a* of the wound end portion 52 contacts the axial end surface 24*a* of the adjusting pipe 24, which is exposed in the holding hole 26. An axial length of the wound end portion 52 is set to be substantially equal to an axial length of the holding hole 26. With the above contact form and the length setting, the holding hole 26 holds only the wound end portion 52 of the valve-closing spring 50.

A loosely received portion 53 of the valve-closing spring 50, which extends from a point adjacent to the valve closing side part of the wound end portion 52 to the wound end portion 54, is loosely coaxially received in the loosely receiving hole 28 in such a manner that a predetermined radial gap 28*a* is interposed between the loosely received portion 53 of the valve-closing spring 50 and the inner peripheral surface of the loosely receiving hole 28. Here, particularly, the ground axial end surface 54*a* of the wound end portion 54 contacts the axial end surface 44*b* of the projection 44, which is slidable in the loosely receiving hole 28.

With the above-described structure, the valve-closing spring 50 exerts the restoring force on the valve closing side relative to the valve member 40 in the state where the valve opening side part of the valve-closing spring 50 is held by the stationary core 20.

Now, advantages of the fuel injection valve 1 of the present embodiment will be described.

In the fuel injection valve 1, the magnetic yoke 63, which reduces the amount of the magnetic flux in the radial direction at the predetermined portion S located in the predetermined circumferential location, has the axial extent, which overlaps with the entire axial extent of the holding hole 26 of the stationary core 20. Therefore, the density distribution of the magnetic flux, which passes the magnetic yoke 63 in the radial direction, is not uniform in the circumferential direction. In this way, when the valve-closing spring 50, which is inserted into and is held in the holding hole 26, receives the influence of the magnetic force applied from the stationary core 20, to which the magnetic flux is guided from the magnetic yoke 63, the valve-closing spring 50 may be magnetically urged against (magnetically attracted to) the inner wall of the holding hole 26 along the entire axial extent of the holding hole 26 on the radial side, which is radially opposite (diametrically opposite) from the predetermined portion S. Therefore, even if the radial position of the valve-closing spring 50 is deviated from the radial side, which is radially opposite from the predetermined portion S, at the time of assembling the fuel injection valve 1, the valve-closing spring 50 will be urged against the inner wall of the holding hole 26 along the entire axial extent of the holding hole 26 on the radial side, which is radially opposite from the predetermined portion S, at the time of operating the fuel injection valve 1. Thereby, it is possible to limit the radial positional deviation of the valve-closing spring 50. As a result, it is possible to limit the variations in the injection quantity of fuel among the individual fuel injection valves caused by the radial positional deviation of the valve-closing spring 50 at the time of assembling. Also, it is possible to limit the variations in the injection quantity of fuel among the individual fuel injection valves caused by the radial positional deviation of the valve-closing spring 50 at each fuel injection operation or caused by the radial positional deviation of the valve-closing spring 50 upon a long time use (aging). Thereby, it is possible to provide the fuel injection valve 1, which implements the stable injection quantity of fuel.

like in the case of the fuel injection valve 1 of the present embodiment, when the axial extent of the predetermined portion S of the second yoke portion 631 of the magnetic yoke 63 overlaps with the entire axial extent of the holding hole 26, the degree of the unequal density distribution of the magnetic flux, which passes the magnetic yoke 63 in the radial direction, is increased in the axial extent of the holding hole 26. Thereby, the magnetic force, which is generated between the stationary core 20 and the valve-closing spring 50, can be reliably increased in the axial extent of the holding hole 26. In this way, the magnetic force, which magnetically urges the valve-closing spring 50 to the radially opposite side, which is radially opposite from the predetermined portion S, can be reliably increased. Thus, it is possible to limit the variations in the injection quantity of fuel among the individual fuel injection valves or among the fuel injection operations or the variations in the injection quantity of fuel upon the aging caused by the radial positional deviation of the valve-closing spring 50. As a result, the stability of the injection quantity of fuel can be improved.

Furthermore, in the valve-closing spring 50, which is the coil spring, the wound end portion 52 has the predetermined number of turns from the valve opening side axial end of the valve-closing spring 50, and this wound end portion 52 does not contribute to the generation of the restoring force in the valve-closing spring 50. Therefore, even though the predetermined number of turns of the valve-closing spring 50 is fitted into and is held in the holding hole 26 as the wound end portion 52 of the valve-closing spring 50, the valve-closing spring 50 can stably generate the desired restoring force at the valve closing side portion of the valve-closing spring 50, which is located on the valve closing side of the predetermined number of turns of the valve-closing spring 50, i.e., the wound end portion 52. Also, when the predetermined number of turns of the valve-closing spring 50, i.e., the wound end portion 52 receives the magnetic force from the stationary core 20, the wound end portion 52 is urged against the inner peripheral wall of the holding hole 26 along the entire axial extent of the holding hole 26 on the radially opposite side, which is radially opposite from the predetermined portion S. Therefore, it is possible to limit the radial positional deviation of the wound end portion 52. Thereby, it is possible to avoid the occurrence of the deterioration of the stability of the injection quantity of fuel caused by the change in the restoring force of the valve-closing spring 50. Also, it is possible to avoid the occurrence of the deterioration of the stability of the injection quantity of fuel caused by the radial positional deviation of the valve-closing spring 50.

Furthermore, the valve closing side portion of the valve-closing spring 50, which is adjacent to the wound end portion 52, forms the loosely received portion 53 of the valve-closing spring 50, which is loosely received in the loosely receiving hole 28 that is adjacent to the holding hole 26 on the valve closing side. Therefore, the loosely received portion 53 will less likely interfere with the stationary core 20 having the loosely receiving hole 28. In this way, it is possible to avoid the deterioration of the stability of the injection quantity of fuel caused by the deterioration of the restoring force of the valve-closing spring 50 upon interference with the stationary core 20.

Figure 4:
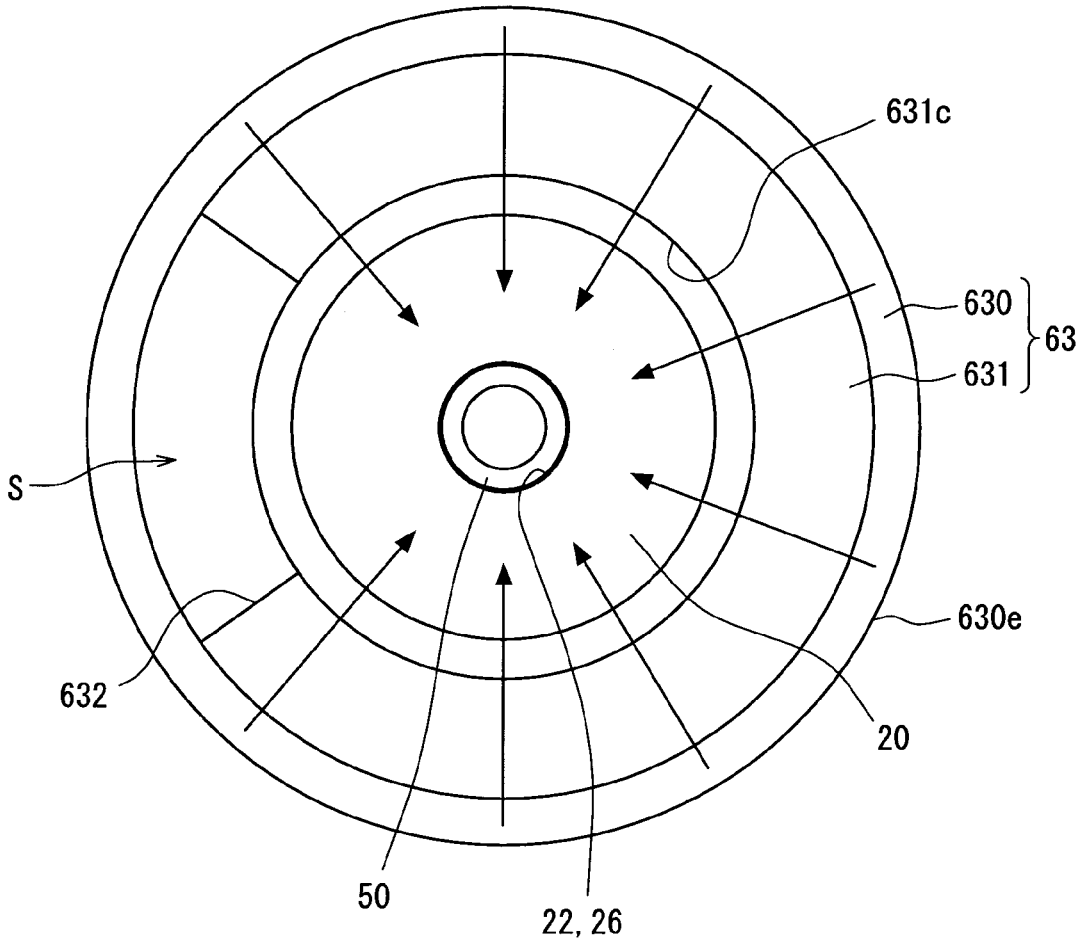
FIG. 4 is a schematic diagram for describing a characteristic feature of the fuel injection valve shown in FIG. 3.

Furthermore, in the magnetic yoke 63 having the second yoke portion 631, which is configured into the partially cut ring form that opens in the predetermined portion S, the flow of the magnetic flux through the predetermined portion S can be reliably reduced, as shown in FIG. 4. In this way, the magnetic force, which urges the valve-closing spring 50 to the radially opposite side, which is radially opposite from the predetermined portion S, can be reliably increased. Thereby, it is possible to limit the variations in the injection quantity of fuel among the individual fuel injection valves or among the fuel injection operations or the variations in the injection quantity of fuel upon the aging caused by the radial positional deviation of the valve-closing spring 50. As a result, the stability of the injection quantity of fuel can be improved.

In addition, the valve member 40 can move relative to the movable core 30. Specifically, in the state where the shaft portion 42 of the valve member 40 axially extends through the movable core 30 in a manner that enables the relative movement of the shaft portion 42 in the movable core 30, the valve member 40 can move integrally with the movable core 30 when the projection 44, which projects from the shaft portion 42, contacts the axial end surface 30*a* of the movable core 30 located on the valve opening side. Therefore, in this contact state, when the movable core 30 is urged toward the valve opening side by the valve-opening spring 51 placed between the valve housing 10 and the movable core 30, the valve member 40 is moved toward the valve opening side against the restoring force of the valve-closing spring 50. As a result, when the movable core 30 is stopped by the stationary core 20 at the moving end of the movable core 30 on the valve opening side, the valve member 40 continues its movement toward the valve opening side to possibly cause the overshooting. However, the overshooting may be limited by the valve-closing spring 50. At this time, the valve-closing spring 50 receives the influence of the magnetic force applied from the stationary core 20, so that the valve-closing spring 50 is urged against the inner peripheral wall of the holding hole 26 along the entire axial extent of the holding hole 26. Therefore, it is possible to limit the radial positional deviation of the valve-closing spring 50. Thereby, the overshooting of the valve member 40 can be reliably and stably limited by the valve-closing spring 50. Thus, even in the structure, in which the valve member 40 is likely to overshoot relative to the movable core 30, the stability of the injection quantity of fuel can be further improved.

The present disclosure has been described with respect to the one embodiment. However, the present disclosure is not limited to the above embodiment, and the above embodiment may be modified in various ways within a principle of the present disclosure.

Figure 5:
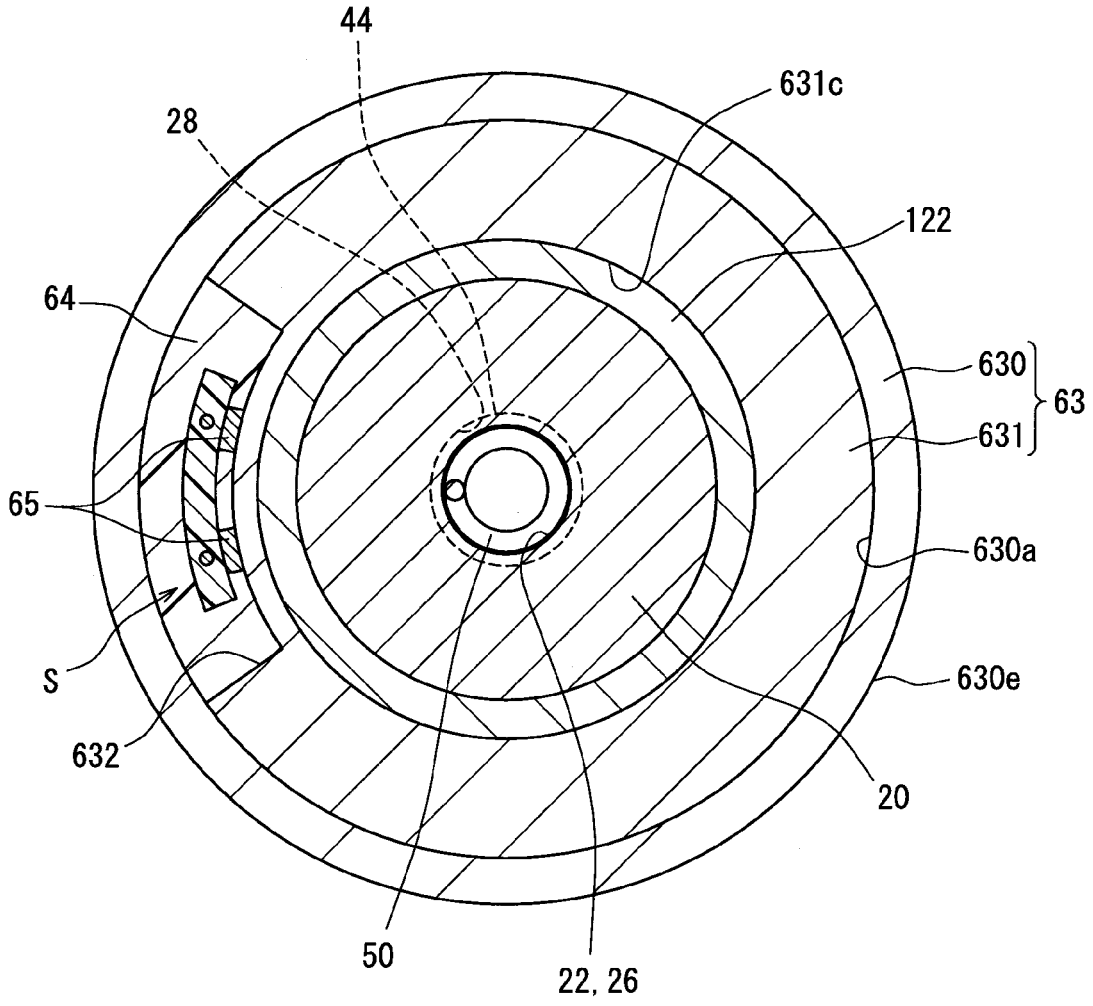
FIG. 5 is a schematic diagram, showing a modification of the structure shown in FIG. 4.

Specifically, in a first modification, as shown in FIG. 5, the opening 632, which reduces the amount of the magnetic flux in the radial direction at the predetermined portion S, may be formed by reducing a radial thickness of the second yoke portion 631 at the predetermined portion S in comparison to a radial thickness of the rest of the second yoke portion 631.

Figure 6:
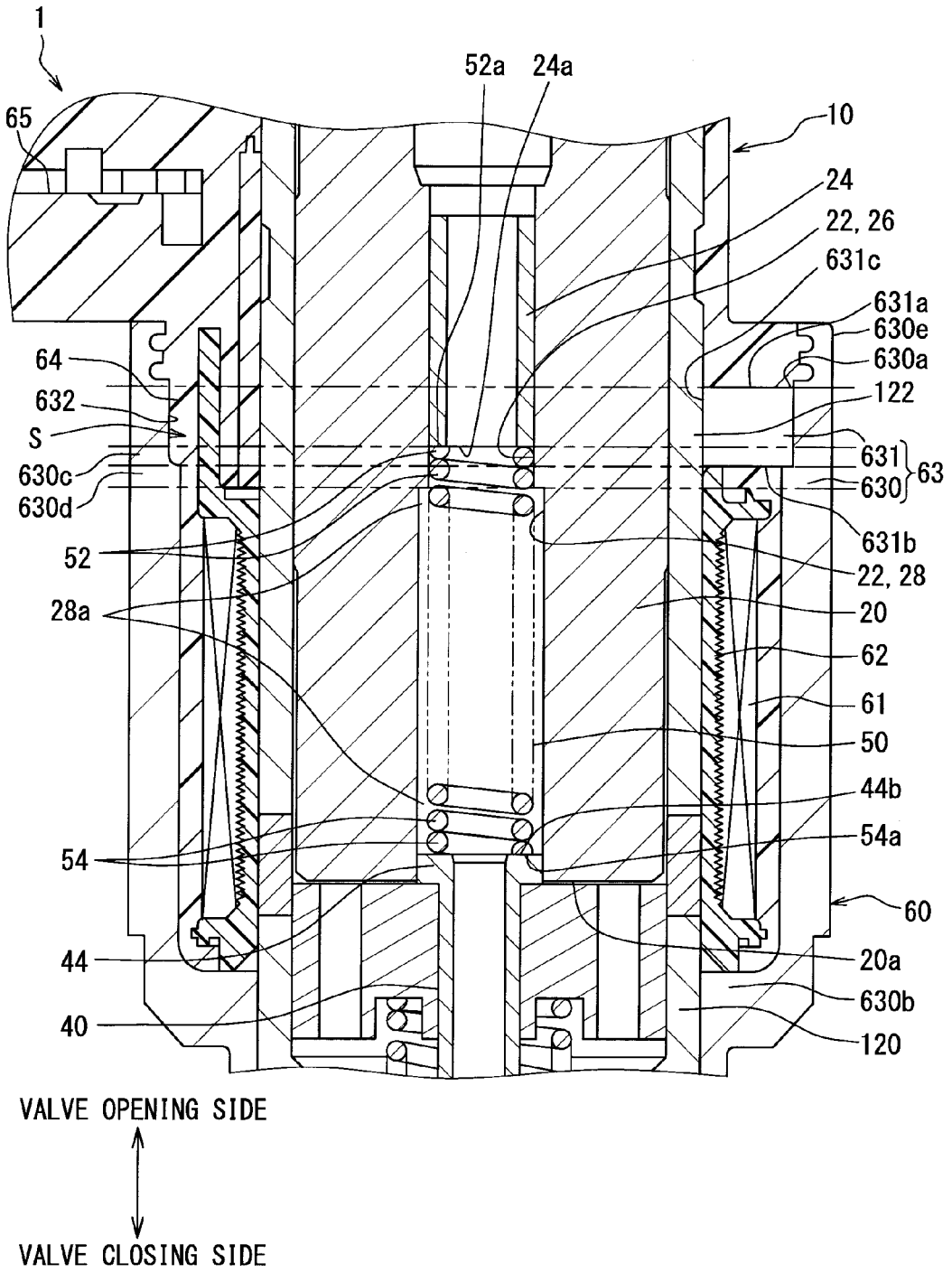
FIG. 6 is a partial schematic cross sectional view, showing a modification of the structure shown in FIG. 2.

In a second modification, as shown in FIG. 6, the axial extent of the portion of the magnetic yoke 63, which overlaps with the entire axial extent of the holding hole 26, may be limited to an axial extent of a part of the predetermined portion S (i.e., a part of the second yoke portion 631 and a part of the outer tubular section 630*c* of the second yoke portion 631) and an axial extent of a valve closing side part of the magnetic yoke 63, which is located on the valve closing side of the predetermined portion S, i.e., an axial extent of an adjacent section 630*d* of cylindrical peripheral wall part 630*e* of the first yoke portion 630. The adjacent section 630*d* is adjacent to the outer tubular section 630*c* on the valve closing side. In the second modification, the axial extent of the predetermined portion S overlaps only with an axial extent of a portion of the holding hole 26. In other words, the entire axial extent of the holding hole 26 is only partially located within the axial extent of the second yoke portion 631.

Figure 7:
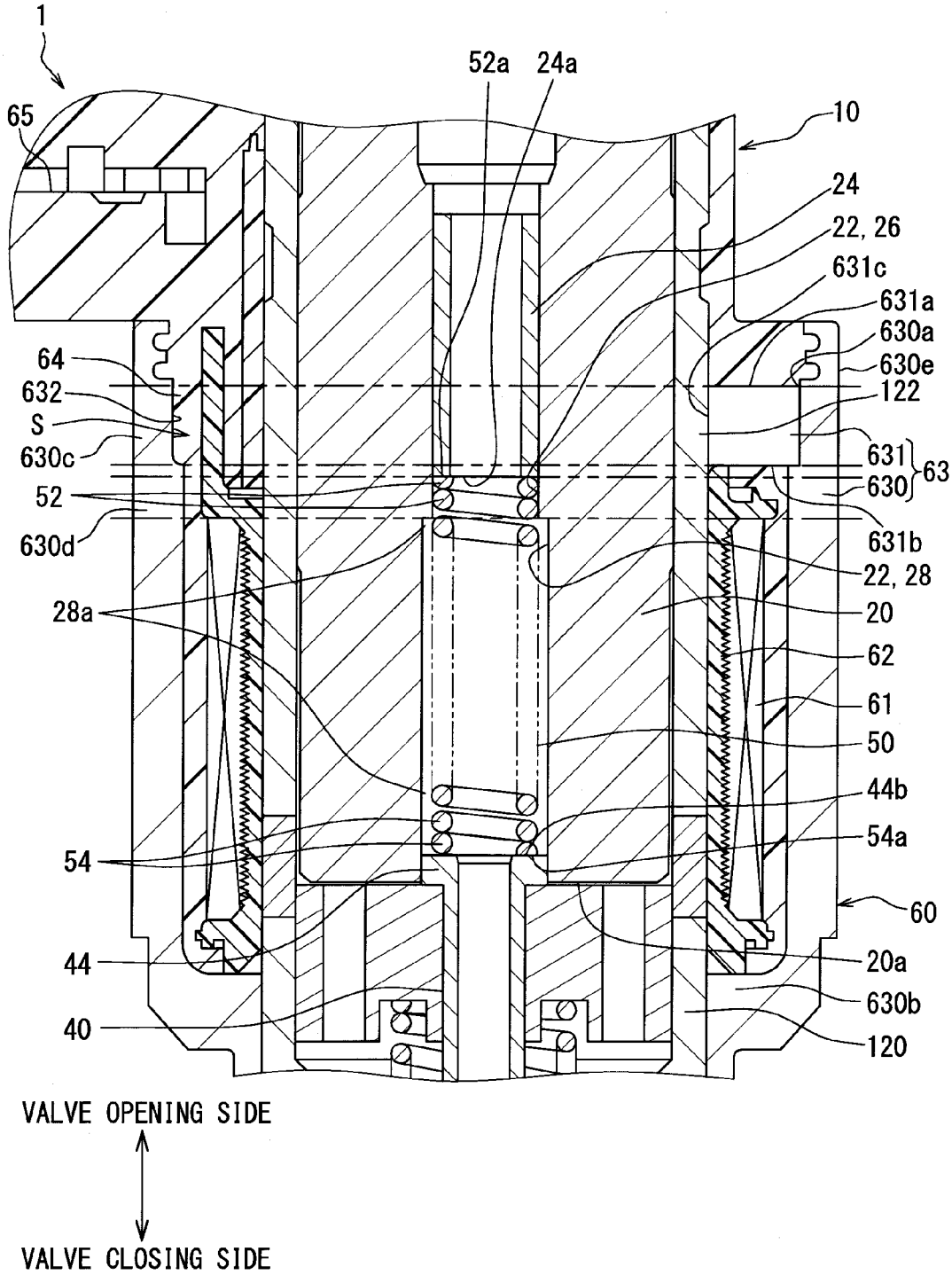
FIG. 7 is a schematic cross sectional view, showing a modification of the structure shown in FIG. 2.

Further alternately, in a third modification, as shown in FIG. 7, the axial extent of the portion of the magnetic yoke 63, which overlaps with the entire axial extent of the holding hole 26, may be limited to a valve closing side part of the magnetic yoke 63, which is located on the valve closing side of the predetermined portion S (i.e., the adjacent section 630*d*, which is adjacent to the outer tubular section 630*c* on the valve closing side in the cylindrical peripheral wall part 630*e* of the first yoke portion 630). In the third modification, the axial extent of the predetermined portion S does not overlap with the axial extent of the holding hole 26.

In a fourth modification, any other type of spring, which is other than the coil spring, may be used as the valve-closing spring 50. Also, in a fifth modification, any other type of spring, which is other than the coil spring, may be used as the valve-opening spring 51.

In a sixth modification, the wound end portion 52 of the valve-closing spring 50 may be loosely fitted into the loosely receiving hole 28 from the holding hole 26. In a seventh modification, an adjacent part of the valve-closing spring 50, which is adjacent to the wound end portion 52 on the valve closing side, may be fitted into and held in the holding hole 26.

In an eighth modification, the projection 44 may be loosely received in the loosely receiving hole 28. In a ninth modification, the valve member 40 may be fixed to the movable core 30 to disable the relative movement of the valve member 40 relative to the movable core 30, and the valve-opening spring 51 may be eliminated. Furthermore, in such a case, the projection 44 may be eliminated.

What is claimed is:

1. A fuel injection valve for an internal combustion engine, comprising:

a valve housing that includes an injection hole, which is configured to inject fuel in the internal combustion engine;

a valve member that is configured to reciprocate between a valve opening side and a valve closing side, which are opposite to each other in an axial direction, to respectively open and close the injection hole;

a stationary core that is fixed to the valve housing;

a movable core that is movable together with the valve member, wherein the movable core moves toward the valve opening side when a magnetic force is exerted between the stationary core and the movable core;

a magnetic spring that is a coil spring that is made of a magnetic material, wherein the magnetic spring is held by the stationary core and urges the valve member toward the valve closing side; and a solenoid device that is held on a radially outer side of the stationary core and generates the magnetic force by guiding a magnetic flux to the stationary core and the movable core in response to energization of the solenoid device, wherein:

the stationary core includes:

a holding hole that receives and holds a wound end portion of the magnetic spring, wherein the wound end portion is fitted into the holding hole and has a predetermined number of turns from an axial end of the magnetic spring, which is located on the valve opening side; and a loosely receiving hole that is axially placed adjacent to the holding hole on the valve closing side and loosely receives a loosely received portion of the magnetic spring, which is placed adjacent to the wound end portion on the valve closing side, wherein an inner diameter of the loosely receiving hole is larger than an inner diameter of the holding hole;

the solenoid device includes a magnetic yoke that extends in the axial direction and has an axial extent, which overlaps with an entire axial extent of the holding hole, wherein the magnetic yoke has a predetermined portion that is located only in a single circumferential location along a circumferential extent of the magnetic yoke and reduces an amount of the magnetic flux, which passes through the magnetic yoke in a radial direction, in comparison to the rest of the circumferential extent of the magnetic yoke, which is other than the single circumferential location; and an axial extent of the predetermined portion of the magnetic yoke overlaps with the entire axial extent of the holding hole and an entire axial extent of the wound end portion of the magnetic spring received in the holding hole; and when the solenoid device is energized, the wound end portion of the magnetic spring is urged against a portion of an inner peripheral wall of the holding hole, which is radially opposite from the single circumferential location where the predetermined portion is placed.

2. The fuel injection valve according to claim 1, wherein a portion of the magnetic yoke is configured into a partially cut ring form, which opens in the predetermined portion.

3. The fuel injection valve according to claim 1, wherein the valve member is movable relative to the movable core.

4. The fuel injection valve according to claim 1, wherein:

the valve member includes a shaft portion, which extends in the axial direction, and a projection, which radially outwardly projects from the shaft portion;

the shaft portion extends through the movable core and is movable relative to the movable core;

when the movable core is moved toward the stationary core and contacts the projection at an axial end surface of the movable core located on the valve opening side, the movable core moves together with the valve member;

when the movable core is moved to a moving end of the movable core on the valve opening side, the movable core contacts the stationary core and is stopped by the stationary core;

the magnetic spring is a valve-closing spring, which is interposed between the stationary core and the valve member; and the fuel injection valve further includes a valve-opening spring, which is interposed between the valve housing and the movable core and urges the movable core toward the valve opening side.

5. The fuel injection valve according to claim 1, wherein:

the magnetic yoke includes:

a first yoke portion that has a cylindrical peripheral wall part; and a second yoke portion that radially inwardly projects from the cylindrical peripheral wall part of the first yoke portion;

the entire axial extent of the holding hole is at least partially located within an axial extent of the second yoke portion; and the predetermined portion includes an opening, which is formed in the second yoke portion and receives a dielectric material.

6. The fuel injection valve according to claim 5, wherein the entire axial extent of the holding hole is entirely located within the axial extent of the second yoke portion.

7. The fuel injection valve according to claim 5, wherein:

the solenoid device includes:

a solenoid coil, which is radially placed between the cylindrical peripheral wall part of the first yoke portion and the stationary core; and a plurality of terminals that are electrically connected to the solenoid coil and extend outward through the opening of the second yoke portion; and the dielectric material, which is received in the opening of the second yoke portion, holds the plurality of terminals in the opening of the second yoke portion.

8. The fuel injection valve according to claim 7, wherein:

the valve housing includes a magnetic portion, which is made of a magnetic material;

the stationary core is fixed to an inner peripheral surface of the magnetic portion of the valve housing;

a contact surface of a radially inner end part of the second yoke portion contacts an outer peripheral surface of the magnetic portion of the valve housing;

the entire axial extent of the holding hole is at least partially located within an axial extent of the contact surface of the radially inner end part of the second yoke portion; and the solenoid coil is radially placed between the cylindrical peripheral wall part of the first yoke portion and the magnetic portion of the valve housing.

* * * * *